US012557845B2

(12) United States Patent
Zhou et al.

(10) Patent No.: US 12,557,845 B2
(45) Date of Patent: Feb. 24, 2026

(54) ELECTRONIC ATOMIZATION DEVICE AND ATOMIZER AND ATOMIZATION ASSEMBLY THEREOF

(71) Applicant: SHENZHEN SMOORE TECHNOLOGY LIMITED, Guangdong (CN)

(72) Inventors: Hongming Zhou, Shenzhen (CN); Zhenyu Wu, Shenzhen (CN); Jicai Long, Shenzhen (CN); Jianxin Xiao, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 549 days.

(21) Appl. No.: 17/829,585

(22) Filed: Jun. 1, 2022

(65) Prior Publication Data

US 2022/0287367 A1 Sep. 15, 2022

Related U.S. Application Data

(63) Continuation of application No. PCT/CN2020/084510, filed on Apr. 13, 2020.

(51) Int. Cl.
*A24F 40/46* (2020.01)
*A24F 40/44* (2020.01)

(52) U.S. Cl.
CPC ..... *A24F 40/46* (2020.01); *A24F 40/44* (2020.01)

(58) Field of Classification Search
CPC ..... A24F 40/46
See application file for complete search history.

(56) References Cited

U.S. PATENT DOCUMENTS

2017/0224018 A1* 8/2017 Li ..... A24F 40/46
2020/0163383 A1* 5/2020 Kessler ..... A24F 40/70

FOREIGN PATENT DOCUMENTS

| | | | |
|---|---|---|---|
| CN | 204317492 | U | 5/2015 |
| CN | 104720109 | A | 6/2015 |
| CN | 104470387 | B | 6/2016 |
| CN | 205624474 | U | 10/2016 |
| CN | 205728069 | U | 11/2016 |
| CN | 206260851 | U | 6/2017 |
| CN | 206284398 | U | 6/2017 |
| CN | 206390305 | U | 8/2017 |
| CN | 107467717 | A | 12/2017 |
| CN | 107581659 | A | 1/2018 |
| CN | 108185535 | A | 6/2018 |
| CN | 104720109 | B | 7/2018 |

(Continued)

OTHER PUBLICATIONS

Translation of CN104720109 (Year: 2024).*

(Continued)

*Primary Examiner* — Michael H. Wilson
*Assistant Examiner* — Jennifer A Kessie
(74) *Attorney, Agent, or Firm* — Leydig, Voit & Mayer, Ltd.

(57) ABSTRACT

A vaporization component includes: a porous body; and a heating body in a shape of a cylindrical mesh. The porous body includes a central through hole. The heating body includes a hollow structure with two run-through ends. The heating body is disposed in the central through hole and is closely connected to the porous body.

18 Claims, 5 Drawing Sheets

(56) References Cited

FOREIGN PATENT DOCUMENTS

| | | | | |
|---|---|---|---|---|
| CN | 108354235 | A | 8/2018 | |
| CN | 109007989 | A | 12/2018 | |
| CN | 208755162 | U | 4/2019 | |
| CN | 209376694 | U | 9/2019 | |
| CN | 209498589 | U | 10/2019 | |
| CN | 212345304 | U | 1/2021 | |
| EP | 3597060 | A2 * | 1/2020 | ..... A24F 40/44 |
| JP | H0823852 | A | 1/1996 | |
| WO | 2015192300 | A1 | 12/2015 | |
| WO | 2016172959 | A1 | 11/2016 | |

OTHER PUBLICATIONS

European Patent Office, Search Report in European Patent Application No. 20931283.4 (Dec. 23, 2022).
Patent Cooperation Treaty, International Search Report, International Application No. PCT/CN2020/084510 (Jan. 12, 2021).
Patent Cooperation Treaty, Written Opinion of the International Searching Authority, International Application No. PCT/CN2020/084510 (Jan. 12, 2021).
Chinese Patent Office, Office Action in Chinese Patent Application No. 202010287416.1 (Oct. 23, 2024).

* cited by examiner

ELECTRONIC ATOMIZATION DEVICE AND ATOMIZER AND ATOMIZATION ASSEMBLY THEREOF

CROSS-REFERENCE TO PRIOR APPLICATION

This application is a continuation of International Patent Application No. PCT/CN2020/084510, filed on Apr. 13, 2020. The disclosure of the application is hereby incorporated by reference herein.

FIELD

The present invention relates to vaporization devices, and more specifically, to an electronic vaporization device and a vaporizer thereof, and a vaporization component.

BACKGROUND

In the related art, vaporization components are widely applied to electronic cigarettes. A vaporization component generally includes a porous body guiding liquid and a heating body disposed on the porous body. Currently, the heating body generally uses a spiral heating wire. The porous body is generally a ceramic porous body, and the heating body may be formed and sintered with the porous body together to obtain an integral vaporization core.

A spiral heating wire is generally formed by simple wire winding. However, the rigidity of the heating wire is relatively poor, and a turn gap thereof easily changes in a preparation process, leading to poor overall heating uniformity. In addition, the heating wire has a relatively small diameter and a small overall heating area, which easily causes a local high temperature, resulting in burnt flavor, poor inhaling experience, and low vaporization efficiency.

In the related art, the vaporization core generally has technical defects such as non-uniform temperature distribution, low vaporization efficiency, and poor inhaling experience, and such defects severely limit further development and application of this industry.

SUMMARY

In an embodiment, the invention provides a vaporization component, comprising: a porous body; and a heating body in a shape of a cylindrical mesh, wherein the porous body comprises a central through hole, wherein the heating body comprises a hollow structure with two run-through ends, and wherein the heating body is disposed in the central through hole and is closely connected to the porous body.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
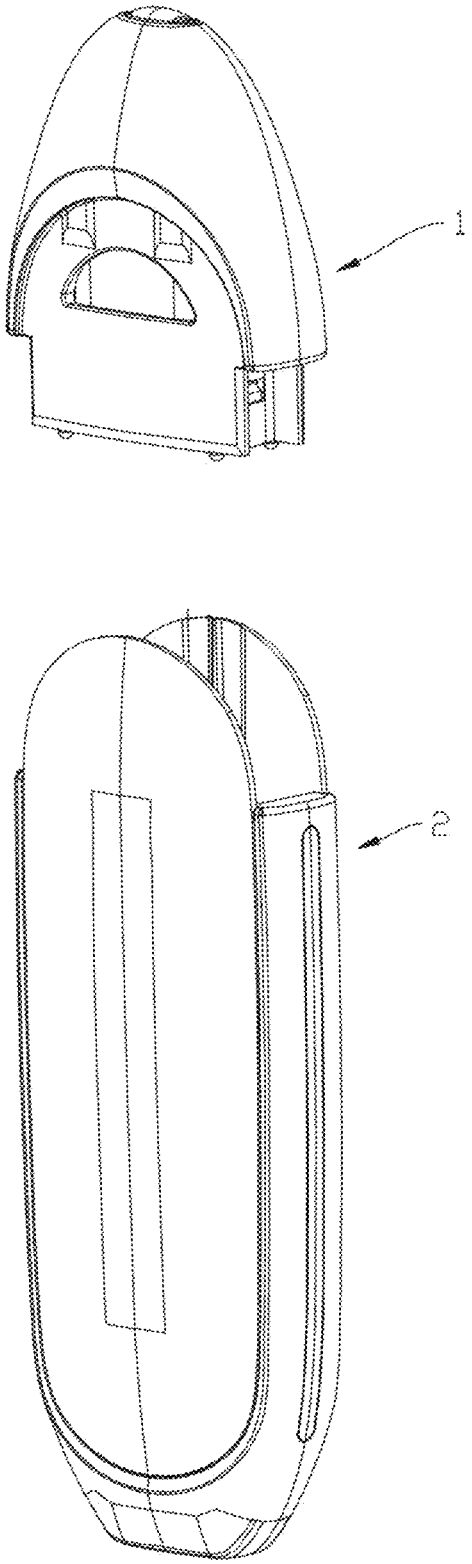
FIG. 1 is a schematic exploded view of a partial structure of an electronic vaporization device according to some embodiments of the present invention.

In an embodiment, the present invention provides an improved vaporization component, and further provides an improved electronic vaporization device and a vaporizer thereof.

In an embodiment, the invention provides a vaporization component, including a porous body and a heating body in a shape of a cylindrical mesh, where the porous body includes a central through hole, the heating body is a hollow structure with two run-through ends, and the heating body is disposed in the central through hole and is closely connected to the porous body.

Preferably, a sidewall of the heating body is at least partially embedded in a sidewall of the porous body.

Preferably, the porous body includes a first sidewall inner surface and a first sidewall outer surface disposed opposite to the first sidewall inner surface;

the heating body includes a second sidewall inner surface and a second sidewall outer surface disposed opposite to the second sidewall inner surface; and the entire heating body is embedded in the porous body, and the second sidewall inner surface of the heating body is flush with the first sidewall inner surface of the porous body.

Preferably, the second sidewall outer surface of the heating body and the first sidewall inner surface of the porous body are closely attached to each other.

Preferably, the heating body is in a shape of a cylinder and includes a plurality of annular heating portions that are disposed at intervals and connected to each other.

Preferably, wire diameters of the plurality of heating portions gradually increase from middle to two ends.

Preferably, the plurality of heating portions are disposed at equal intervals.

Preferably, a size of a longitudinal section of each heating portion gradually decreases from internal to external.

Preferably, the heating body further includes two annular electrode portions disposed on two ends of the plurality of heating portions; and the electrode portions are spaced apart from the heating portions, and a width of the electrode portion in an axial direction is greater than a width of the heating portion.

Preferably, the heating body further includes connection portions each connecting two adjacent heating portions.

Preferably, a width of the connection portion in an axial direction is slightly greater than a width of the heating portion.

Preferably, two opposite sides in a radial direction of each heating portion are each connected to one of the connection portions.

Preferably, the connection portion is disposed perpendicular to an end surface of the heating portion.

Preferably, the heating body includes a plurality of mesh holes; and a gap between two adjacent heating portions and/or a gap between the heating portion and the electrode portion forms the mesh hole.

Preferably, two ends of the mesh hole are arc-shaped.

Preferably, the vaporization component further includes two electrodes disposed on the two electrode portions and passing through the porous body; and the two electrodes are disposed in the same radial direction of the heating body.

Preferably, a porosity of the porous body is 40% to 85%; and/or a thickness of the heating body is 0.05 mm to 0.3 mm; and/or a hole wall thickness of the central through hole is 0.5 mm to 5 mm; and/or a height of the heating body is less than a depth of the central through hole of the porous body, and the height of the heating body is 4 mm to 8 mm; and/or a resistance of the heating body is 0.6Ω to 1.4Ω, and output power of the heating body is 8 W to 16 W.

Preferably, the porous body is a ceramic porous body;

the heating body is a metal heating mesh; and the heating body and the ceramic porous body form an integral structure through sintering.

The present invention further provides a vaporizer, including a vaporization housing and the vaporization component described in the present invention and disposed in the vaporization housing.

The present invention further provides an electronic vaporization device, including the vaporizer described in the present invention and a power supply device connected to the vaporizer.

The electronic vaporization device and the vaporizer thereof, and the vaporization component of the present invention have the following beneficial effects: in the vaporization component, the heating body in a shape of a cylindrical mesh is disposed in the central through hole of the porous body and is closely connected to the porous body, so that the overall heating uniformity of the heating body can be further improved, burnt flavor caused by local high temperature can be avoided, and inhaling experience and vaporization efficiency can be improved.

In order to have a clearer understanding of the technical features, the objectives, and the effects of the present invention, specific implementations of the present invention are now illustrated in detail with reference to the accompanying drawings.

It should be understood that, terms such as "front", "rear", "left", "right", "upper", "lower", "first", and "second" are merely used for ease of describing the technical solutions of the present invention, rather than indicating a mandatory particular distinction of the mentioned device or component. Therefore, such terms should not be construed as limiting of the present invention. It should be noted that, when a component is considered to be "connected to" another component, the component may be directly connected to the another component, or an intervening component may also be present. Unless otherwise defined, meanings of all technical and scientific terms used in this specification are the same as those usually understood by a person skilled in the technical field to which the present invention belongs. In this specification, terms used in the specification of the present invention are merely intended to describe objectives of the specific embodiments, but are not intended to limit the present invention.

Figure 2:
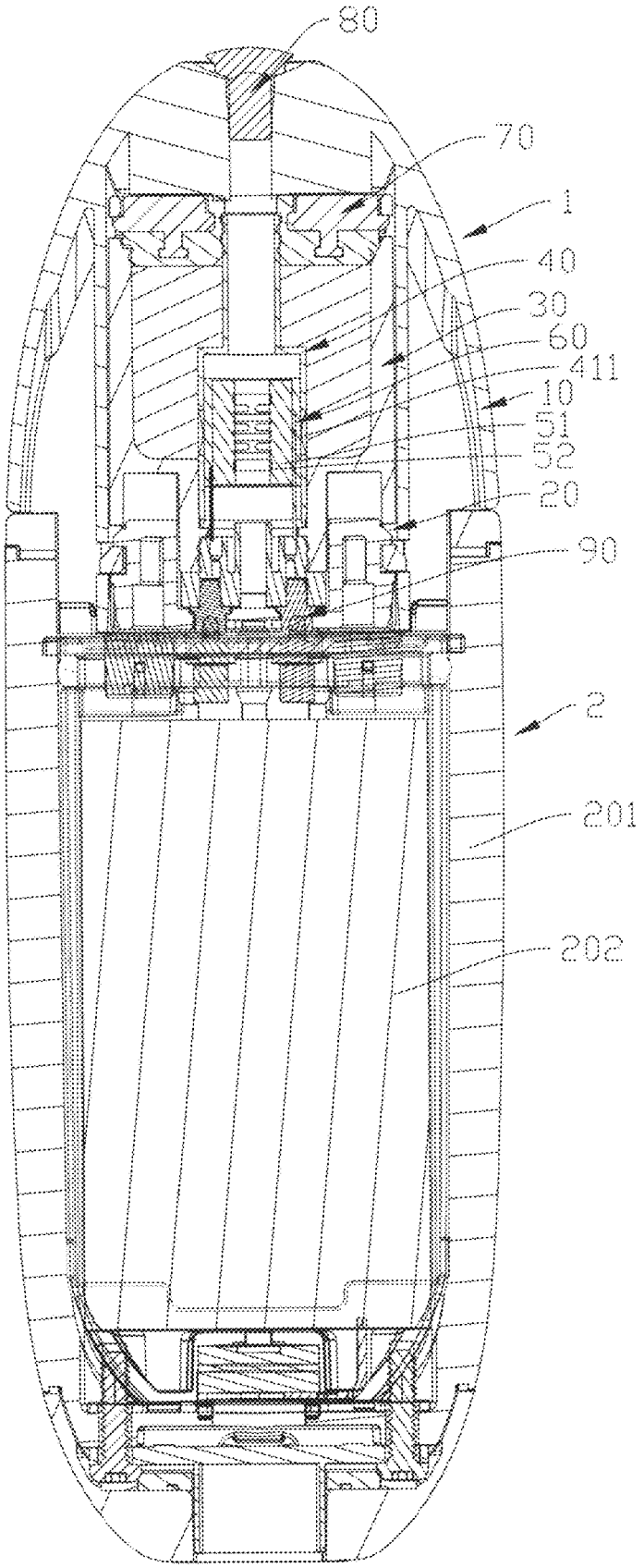
FIG. 2 is a cross-sectional view of the electronic vaporization device shown in FIG. 1.

FIG. 1 and FIG. 2 show some preferred embodiments of an electronic vaporization device in the present invention. The electronic vaporization device is configured to heat and vaporize e-liquid, and may include a vaporizer 1 and a power supply device 2. The vaporizer 1 can heat and vaporize a vaporization medium in an energized state. The power supply device 2 includes a power supply housing 201 and a battery component disposed in the power supply housing 201. The vaporizer 1 may be partially placed in the power supply housing 201 and mechanical and electrically connected to the battery component, and power supply is supplied to the vaporizer through the battery component of the power supply device 2.

Figure 3:
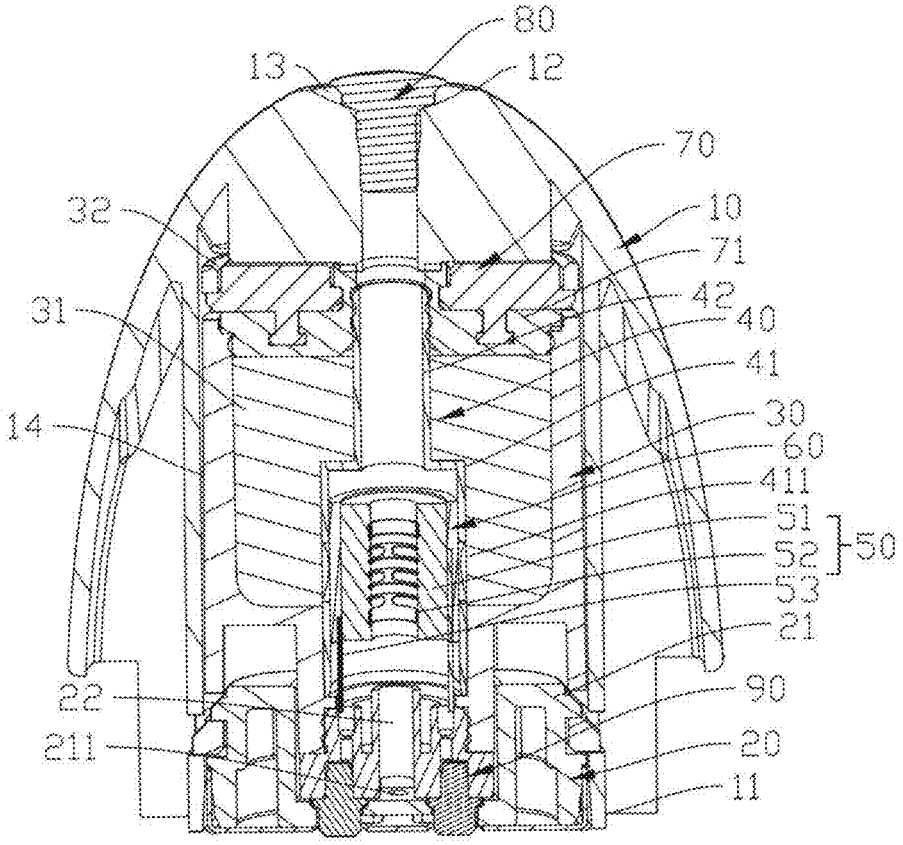
FIG. 3 is a cross-sectional view of a vaporizer of the electronic vaporization device shown in FIG. 2.

As shown in FIG. 2 and FIG. 3, the vaporizer 1 includes a vaporization housing 10, a base 20, a liquid storage device 30, a vent tube 40, and a vaporization component 50. The vaporization housing 10 is sleeved on the periphery of the base 20 and configured to accommodate components such as the liquid storage device 30, the vent tube 40, and the vaporization component 50. The base 20 is placed in the vaporization housing 10 and configured to mount the liquid storage device 30, the vent tube 40, and the vaporization component 50. A liquid storage cavity 31 may be formed on an inner side of the liquid storage device 30 and configured to store the vaporization medium. The vent tube 40 is disposed in the liquid storage device 30, and an airflow channel is formed on an inner side of the vent tube for circulation of air. The vaporization component 50 may be accommodated in the vent tube 40 and in fluid connection to the liquid storage cavity 31 in the liquid storage device 30, and may be electrically connected to the battery component 202 of the power supply device 2, so that the vaporization component can heat and vaporize the vaporization medium guided from the liquid storage cavity 31 in an energized state. In some embodiments, the vaporization medium may be e-liquid.

In some embodiments, the vaporization housing 10 includes an opening end 11 located at the bottom and a suction nozzle end 12 disposed opposite to the opening end 11. The opening end 11 may be combined with the base 20. The suction nozzle end 12 includes an air outlet 13, and the air outlet 13 is in communication with the vent tube 40 for a user to inhale vapor through a mouth. An accommodating cavity 14 located in a middle part may be formed on an inner side of the vaporization housing 10 to accommodate the liquid storage device 30.

Further, in some embodiments, the base 20 is stuffed into the vaporization housing 10 from the opening end of the vaporization housing 10 and includes a base body 21 and a first airflow channel 22, where a shape and a size of a cross section of the base body 21 match a shape and a size of a cross section of the vaporization housing 10. The first airflow channel 22 is disposed on the base body 21 and located at a central axis of the base body 21. The first airflow channel is arranged along a thickness direction of the base body 21 and is in communication with the vent tube 40, for vapor to enter the vent tube 40. The bottom of the base body 21 is provided with an air inlet 211 in communication with the first airflow channel 22.

Further, in some embodiments, the liquid storage device 30 is in a shape of a hollow cylinder and sleeved on the periphery of the vent tube 40; the annular liquid storage cavity 31 is formed on the inner side of the liquid storage device. One end of the liquid storage device 30 is sleeved on the base 20, and the other end is provided with an opening; the opening is provided with a sealing cover 70 to seal the liquid storage device 30; and the sealing cover 70 is provided with a sealing structure 71 to be connected to the liquid storage device 30 in a sealing manner. In some embodiments, the sealing structure 71 may be a silicone component.

Further, in some embodiments, the vent tube 40 includes a first tube section 41 and a second tube section 42 connected to the first tube section 41; a radial size of the first tube section 41 is greater than a radial size of the second tube section 42. The first tube section 41 is disposed on the base 20, sleeved on an upper portion of the first airflow channel 22, and in communication with the airflow channel. A sidewall of the first tube section 41 may be provided with a liquid guiding hole 411. Two liquid guiding holes 411 are provided, which are respectively located on two opposite sides of the first tube section 41 and in fluid connection to the liquid storage cavity 31. The second tube section 42 is disposed on one end of the first tube section 41 away from the base 20 and is integrally formed with the first tube section 41, and one end of the second tube section 42 away from the first tube section 41 is in communication with the air outlet 13 on the vaporization housing 10.

Figure 4:
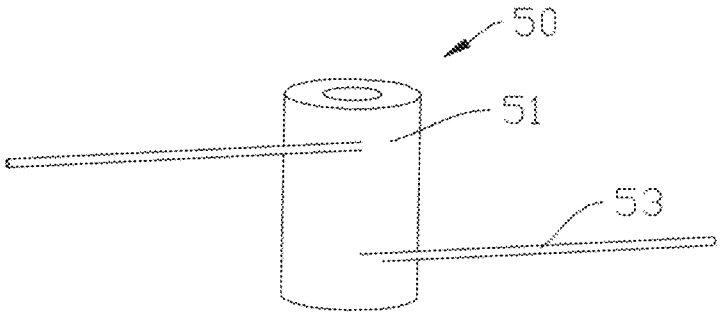
FIG. 4 is a schematic structural diagram of a vaporization component of the vaporizer shown in FIG. 3.
Figure 5:
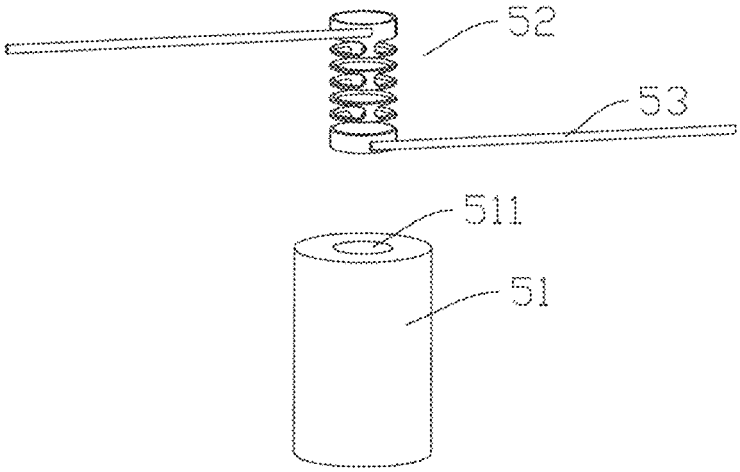
FIG. 5 is a schematic structural exploded view of the vaporization component shown in FIG. 4.
Figure 6:
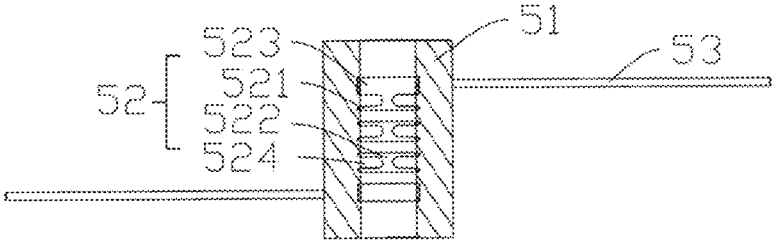
FIG. 6 is a cross-sectional view of the vaporization component shown in FIG. 4.

As shown in FIG. 4 to FIG. 6, the vaporization component 50 is accommodated in the first tube section 41 and includes a porous body 51 and a heating body 52. The porous body 51 is in fluid connection to the liquid storage cavity 31 through the liquid guiding hole 411 and configured to inhale the vaporization medium from the liquid storage cavity 31. The heating body 52 is disposed in the porous body 51 and configured to heat the vaporization medium in the porous body 51.

In some embodiments, the porous body 51 is in a shape of a column. It may be understood that, in some other embodiments, the porous body 51 is not limited to the shape of a column. In some embodiments, the porous body 51 includes a central through hole 511. Two ends of the central through hole 511 are in communication with each other, and a vaporization cavity may be formed on an inner side of the central through hole, where one end of the central through hole may be in communication with the first airflow channel 22, and the other end of the central through hole may be in communication with the second tube section 42 for circulation of air and for ease of transmitting vapor out. In this embodiment, the porous body 51 may include a first sidewall inner surface and a first sidewall outer surface, where the first sidewall inner surface and the first sidewall outer surface are disposed opposite to each other, and the first sidewall inner surface is located in the central through hole 511.

In some embodiments, the porous body 51 is a ceramic porous body, and is made of one or more of the following materials: diatomite, quartz, mullite, aluminum oxide, silicon carbide, silicon nitride, and titanium boride. In some embodiments, the porous body 51 may be made of a diatomite material with lower thermal conductivity. In some embodiments, a porosity of the porous body is 40% to 85%, and preferably, 55% to 65%. In some embodiments, a pore size of the porous body is 5 um to 100 um; and specifically, may be 15 um to 30 um. In some embodiments, the porosity is greater than a porosity of an existing porous body, so that a liquid guiding speed may be improved, to generate a larger amount of vapor. In some embodiments, a thickness of a hole wall of the central through hole 511 may be 0.5 mm to 5 mm, so that heat can be quickly conducted to an outer surface of the porous body 51, to further preheat the vaporization medium. In some embodiments, a depth of the central through hole 511 may be greater than a height of the heating body 52, to further prevent the heating body 52 from dry burning.

Further, in some embodiments, the heating body 52 may be in a shape of a cylindrical mesh. Specifically, the heating body is a cylindrical hollow structure with two run-through ends. A second airflow channel is formed on an inner side of the heating body and in communication with the first airflow channel 22 and the first tube section 41, to transmit vapor out. The heating body 52 may include a second sidewall inner surface and a second sidewall outer surface; and the second sidewall inner surface and the second sidewall outer surface are disposed opposite to each other. The heating body 52 may be disposed in the central through hole 511 and closely connected to the porous body 51. Specifically, in some embodiments, the heating body 52 may be entirely embedded in the porous body 51 in a radial direction of the porous body 51, namely, embedded in the porous body 51 along a flowing direction of the vaporization medium (that is, a distance direction from an outer side surface to an inner side surface of the porous body). The second sidewall inner surface of the heating body is flush with the first sidewall inner surface of the porous body 51, and the heating body may be integrally formed with the porous body 51 through sintering, to further enhance the stability of cooperation with the porous body 51, improve heating uniformity and vaporization efficiency, increase the amount of generated vapor, and prevent the heating body 52 from dry burning. It may be understood that, in some other embodiments, the sidewall of the heating body 52 may be alternatively partially embedded in the porous body 51 in the radial direction of the porous body 51. Certainly, it may be understood that, in some other embodiments, the heating body 52 may be disposed on the first sidewall inner surface of the central through hole 511, and the second sidewall outer surface of the heating body may be closely attached to the first sidewall inner surface of the porous body 51, to help heat the vaporization medium in the porous body 51, prevent dry burning, and improve heating uniformity.

In some embodiments, the heating body 52 is a metal heating mesh, and may be made of one or more of the following materials: nickel chrome, nickel-chromium-iron, iron-chromium-aluminum, 316 stainless steel, titanium and titanium alloy, nickel titanium, nickel zirconium, and high-temperature cobalt-base alloy. A thickness of the heating body 52 may be 0.05 mm to 0.3 mm, and an overall height is 4 mm to 8 mm, where the height is less than the depth of the central through hole 511 of the porous body 51, and the heating body is disposed in a middle part of the central through hole 511. In some embodiments, a resistance of the heating body 52 may be 0.6Ω to 1.4Ω, and input power of the heating body 52 may be 8 W to 16 W. In the height range and the resistance range, by using the input power, the heating body can cause the amount of vapor generated from the vaporization medium to be suitable for an inhaling range of lung capacity of a human body.

Figure 7:
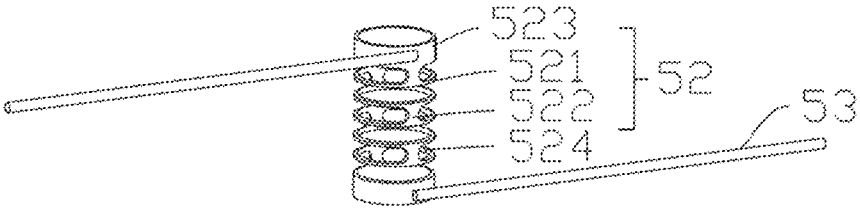
FIG. 7 is a schematic structural diagram of a heating body shown in FIG. 5.

As shown in FIG. 7, in some embodiments, the heating body 52 includes a plurality of heating portions 521 and connection portions 522. Each heating portion 521 is in a shape of a circular ring, the plurality of heating portions 521 are disposed at intervals and are connected to each other to form a column structure. The plurality of heating portions 521 are disposed at equal intervals. Each of the connection portions 522 is disposed between two adjacent heating portions 521, and is configured to connect the two adjacent heating portions 521.

In some embodiments, wire diameters of the plurality of heating portions 521 gradually increase from middle to two ends, and turn gaps of the plurality of heating portions 521 are maintained consistent. In this way, liquid storage and supply of the porous body 51 near each heating portion 521 can be ensured consistent, thereby improving the overall heating uniformity, effectively avoiding local high temperature, and improving inhaling experience. In some embodiments, a diameter of the heating portion 21 is 0.05 mm to 0.3 mm, and a turn gap is 0.2 mm to 0.6 mm.

In some embodiments, a width of a cross section of the heating portion 521 gradually decreases from internal to external. That is, the width of the cross section of the heating portion gradually decreases in a direction from a surface in contact with the porous body to a surface away from the porous body, so that a relatively large direct heating vaporization surface can be obtained while a specific resistance is ensured, and vaporization efficiency can be improved while e-liquid feeding is sufficient, thereby obtaining a relatively large amount of vapor under specific power.

In some embodiments, the connection portion 522 is located in an axial direction of the heating body 52, and a width of the connection portion in the axial direction is greater than a width of the heating portion 521. In some embodiments, the width of the connection portion in the axial direction may be slightly greater than the width of the heating portion 521, so that a current can flow through the connection portion 522 more effectively, thereby reducing current consumption. Specifically, the width of the connection portion in the axial direction is 0.1 mm to 1.0 mm.

Two adjacent heating portions 521 are connected through one connection portion 522. That is, two opposite sides in a radial direction of each heating portion 521 are each connected to one connection portion 522. It may be understood that, in some other embodiments, two adjacent heating portions 521 may be alternatively connected through a plurality of connection portions 522. The connection portion 522 may be disposed perpendicular to an end surface of the heating portion 521, so that stress and heat at a junction may be more concentrated, to further enhance the rigidity of the heating body 52. By connecting the two opposite sides in the radial direction to the connection portions 522 respectively, the two connection portions 522 can be disposed symmetrically, to achieve a longest current path and higher heating uniformity. It may be understood that, in some other embodiments, two pairs of connection portions 522 may be provided, and each pair of connection portions 522 may include two connection portions 522 disposed symmetrically, where one connection portion 522 may be connected to a previous heating portion 521, and the other connection portion 522 may be connected to a next heating portion 521. Connecting lines of the two pairs of connection portions 522 may be cross-shaped in space, so that heating may be more uniform. Alternatively, three or more pairs of connection portions 522 may be provided, and the connection portions may be uniformly distributed along a circumferential direction of the heating portion 521.

In some embodiments, two opposite sidewalls of the connection portion 522 in the circumferential direction of the heating portion 521 may be recessed arc surfaces. Certainly, it may be understood that, in some other embodiments, the two opposite sidewalls of the connection portion 522 may be not limited to recessed arc surfaces, and may be alternatively planes.

Further, in some embodiments, the plurality of heating portions include two electrode portions 523. The two electrode portions 523 are disposed at two ends of the plurality of heating portions 521 and are spaced apart from the heating portions 521. The electrode portion is annular and connected to the heating portion 521 through the connection portion 522, and a width of the electrode portion in the axial direction may be greater than the width of the heating portion 521. Specifically, the width of the electrode portion may be three to eight times of the width of the heating portion 521, which may be used for a current to pass through.

In some embodiments, the heating body 52 may further include a plurality of mesh holes 524. In some embodiments, a gap between two adjacent heating portions 521 and a gap between the heating portion 521 and the electrode portion 523 may all form the mesh holes 524. In some embodiments, the mesh hole 524 may be annular, and two ends of the mesh hole that are disposed corresponding to the connection portion 522 may be arc-shaped, so that a contact area of a junction of the connection portion 522 and the heating portion 521 may be increased, and a resistance of the junction is decreased. As a result, heat and stress at the junction of the connection portion 522 and the heating portion 521 are both decreased, and a resistance of a middle position of the connection portion 522 is increased, thereby increasing heat. It may be understood that, in some other embodiments, the two ends of the mesh hole 524 are not limited to arc-shaped, and may be linear.

Further, in some embodiments, the vaporization component further includes two electrodes 53. The two electrodes 53 may be respectively disposed on the two electrode portions 523. When the heating body 52 and the porous body 51 are assembled, the two electrodes may respectively pass through the porous body 51, so as to be electrically connected to the power supply device 2. In some embodiments, the electrodes 53 may be fixed on the two electrode portions 523 through soldering. The two electrodes 53 are disposed in the same radial direction of the heating body 52, so that a path of a current in the heating body 52 is the longest, to improve the heating uniformity of the heating body 52.

As shown in FIG. 2 and FIG. 3, in some embodiments, the vaporizer 1 further includes a liquid locking structure 60. The liquid locking structure 60 may be disposed in the first tube section 41, may be a hollow tube with two run-through ends, and may be sleeved on the periphery of the porous body 51 and configured to lock the vaporization medium on the porous body 51.

In some embodiments, the vaporizer 1 further includes a mouthpiece plug 80. The mouthpiece plug 80 may be detachably disposed at the suction nozzle end 12 of the vaporization housing 10 and is inserted in the air outlet 13, to prevent the vaporization medium from being leaked out from the air outlet 13 when the vaporizer 1 is temporarily turned off.

In some embodiments, the vaporizer further includes an electrode component 90. Two electrode components 90 may be provided, which are disposed on the base 20 and may be electrically connected to the electrodes of the vaporization component 50 and the battery component 202 of the power supply device 2, so as to energize the vaporization component 50.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporization component, comprising:

a porous body; and a heating body in a shape of a cylindrical mesh, wherein the porous body comprises a central through hole, wherein the heating body comprises a hollow structure with two run-through ends, wherein the heating body is disposed in the central through hole and is connected to the porous body, wherein the heating body is in a shape of a cylinder and comprises a plurality of annular heating portions that are disposed at intervals and connected to each other, wherein the heating body comprises two annular electrode portions disposed on two ends of the plurality of annular heating portions, wherein the two annular electrode portions are spaced apart in an axial direction from the plurality of annular heating portions, and wherein a width of a respective annular electrode portion of the two annular electrode portions in the axial direction is greater than a width of a respective annular heating portion of the plurality of annular heating portions.

2. The vaporization component of claim 1, wherein the heating body is at least partially embedded in the porous body.

3. The vaporization component of claim 2, wherein the porous body comprises a first sidewall inner surface and a first sidewall outer surface disposed opposite the first sidewall inner surface, wherein the heating body comprises a second sidewall inner surface and a second sidewall outer surface disposed opposite the second sidewall inner surface, wherein the heating body is entirely embedded in the porous body, and wherein the second sidewall inner surface of the heating body is flush with the first sidewall inner surface of the porous body.

4. The vaporization component of claim 3, wherein the second sidewall outer surface of the heating body and the first sidewall inner surface of the porous body are closely attached to each other.

5. The vaporization component of claim 1, wherein each annular heating portion of the plurality of annular heating portions comprises a wire having a wire diameter, and wherein the wire diameters of the plurality of annular heating portions increase from a middle thereof to two ends thereof.

6. The vaporization component of claim 1, wherein annular heating portions of the plurality of annular heating portions are disposed at equal intervals.

7. The vaporization component of claim 1, wherein a size of a longitudinal section of each annular heating portion of the plurality of annular heating portions decreases from an internal portion of the longitudinal section to an external portion of the longitudinal section.

8. The vaporization component of claim 1, wherein the heating body further comprises connection portions each connecting two adjacent annular heating portions of the plurality of annular heating portions.

9. The vaporization component of claim 8, wherein a width of a respective connection portion of the connection portions in the axial direction is greater than a width of a respective annular heating portion of the two adjacent annular heating portions.

10. The vaporization component of claim 8, wherein two opposite sides in a radial direction of each annular heating portion of the two adjacent annular heating portions are each connected to one of the connection portions.

11. The vaporization component of claim 8, wherein each connection portion of the connection portions is disposed perpendicular to an end surface of a respective annular heating portion of the plurality of annular heating portions.

12. The vaporization component of claim 1, wherein the heating body comprises a plurality of mesh holes, and wherein a gap between two adjacent heating portions of the plurality of annular heating portions and/or a gap between a respective annular heating portion of the plurality of annular heating portions and a respective annular electrode portion of the two annular electrode portions forms a mesh hole of the plurality of mesh holes.

13. The vaporization component of claim 12, wherein two ends of the mesh hole are arc-shaped.

14. The vaporization component of claim 1, further comprising:

two electrodes disposed on the two annular electrode portions respectively and passing through the porous body, wherein the two electrodes are disposed in a same radial direction of the heating body.

15. The vaporization component of claim 1, wherein a porosity of the porous body is 40% to 85%, and/or wherein a thickness of the heating body is 0.05 mm to 0.3 mm, and/or wherein a hole wall thickness of the central through hole is 0.5 mm to 5 mm, and/or wherein a height of the heating body is less than a depth of the central through hole of the porous body, and the height of the heating body is 4 mm to 8 mm, and/or wherein a resistance of the heating body is 0.6Ω to 1.4Ω.

16. The vaporization component of claim 1, wherein the porous body comprises a ceramic porous body, wherein the heating body comprises a metal heating mesh, and wherein the heating body and the ceramic porous body form an integral structure through sintering.

17. A vaporizer, comprising:

a vaporization housing; and the vaporization component of claim 1, the vaporization component being disposed in the vaporization housing.

18. An electronic vaporization device, comprising:
the vaporizer of claim 17; and
a power supply device connected to the vaporizer.

* * * * *